US009847203B2

(12) United States Patent
Goldstein et al.

(10) Patent No.: US 9,847,203 B2
(45) Date of Patent: Dec. 19, 2017

(54) LOW CURRENT FUSE

(75) Inventors: Alona Goldstein, Jerusalem (IL); Irina Daynov, Givat Zeev (IL); Herzl Ovadia, Givat Zeev (IL); Elinor O'Neill, Mevaseret Zion (IL); Michael Dakhyia, Or Yehdua (IL); Evgeny Glickman, Jerusalem (IL)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 13/270,855

(22) Filed: Oct. 11, 2011

(65) Prior Publication Data

US 2012/0092123 A1 Apr. 19, 2012

Related U.S. Application Data

(60) Provisional application No. 61/393,149, filed on Oct. 14, 2010.

(51) Int. Cl.

*H01H 85/48* (2006.01)
*H01H 85/041* (2006.01)
*H01H 85/06* (2006.01)

(52) U.S. Cl.

CPC ..... *H01H 85/0411* (2013.01); *H01H 85/06* (2013.01); *H01H 2085/0414* (2013.01)

(58) Field of Classification Search

CPC ..... H01H 85/0411; H01H 85/06; H01H 2085/0414

(Continued)

(56) References Cited

U.S. PATENT DOCUMENTS 4,852,227 A 8/1989 Burks
5,134,539 A * 7/1992 Tuckerman et al. ..... 361/311

(Continued)

FOREIGN PATENT DOCUMENTS

CN 1153577 A 7/1997
CN 1649065 A 8/2005

(Continued)

OTHER PUBLICATIONS

International Search Report for PCT International Application No. PCT/IL2011/000820; date of completion of international search: Sep. 24, 2012; dated Oct. 1, 2012.

(Continued)

*Primary Examiner* — Anatoly Vortman
(74) *Attorney, Agent, or Firm* — Dority & Manning, P.A.

(57) ABSTRACT

A multi layer fuse device includes a substrate and an elongated fuse element, having a pair of contact pads formed therewith at opposed longitudinal ends thereof formed on one surface of the substrate. A pair of passivation layers are provided covering the fuse and contact pads. Windows may be opened through both passivation layers above both of the contact pads, and conductive electrode material is electroplated through the windows to contact the contact pads and to extend partially above a top surface of the passivation layers. Exposed electroplated material may be coated with solderable conductive material or a surface mount termination may be provided. Electroplated material may cover a portion of the fuse surface prior to application of the passivation layers and extend to an end of the substrate so that windows are not required.

13 Claims, 4 Drawing Sheets

(58) Field of Classification Search
USPC ..... 337/186, 187, 227, 228, 296, 297
See application file for complete search history.

(56) References Cited

U.S. PATENT DOCUMENTS

| | | | | | |
|---|---|---|---|---|---|
| 5,166,656 | A | | 11/1992 | Badihi et al. | |
| 5,228,188 | A | | 7/1993 | Badihi et al. | |
| 5,296,833 | A | | 3/1994 | Breen et al. | |
| 5,432,378 | A | * | 7/1995 | Whitney et al. | 257/529 |
| 5,552,757 | A | * | 9/1996 | Blecha et al. | 337/297 |
| 5,569,880 | A | * | 10/1996 | Galvagni et al. | 174/527 |
| 5,585,662 | A | | 12/1996 | Ogawa | |
| 5,606,301 | A | * | 2/1997 | Ishimura | 337/290 |
| 5,699,032 | A | | 12/1997 | Ulm, Jr. et al. | |
| 5,708,291 | A | | 1/1998 | Bohr et al. | |
| 5,726,621 | A | * | 3/1998 | Whitney et al. | 337/297 |
| 5,914,649 | A | * | 6/1999 | Isono et al. | 337/290 |
| 5,923,239 | A | * | 7/1999 | Krueger et al. | 337/297 |
| 5,929,741 | A | * | 7/1999 | Nishimura et al. | 337/290 |
| 5,969,404 | A | | 10/1999 | Bohr et al. | |
| 6,034,589 | A | * | 3/2000 | Montgomery et al. | 337/296 |
| 6,043,966 | A | * | 3/2000 | Krueger et al. | 361/104 |
| 6,258,700 | B1 | | 7/2001 | Bohr et al. | |
| 6,337,507 | B1 | | 1/2002 | Bohr et al. | |
| 6,902,256 | B2 | | 6/2005 | Anderson et al. | |
| 7,116,208 | B2 | * | 10/2006 | Nishimura et al. | 337/296 |
| 7,385,475 | B2 | * | 6/2008 | Bender et al. | 337/297 |
| 7,436,284 | B2 | | 10/2008 | Bender et al. | |
| 7,570,148 | B2 | | 8/2009 | Parker et al. | |
| 9,190,235 | B2 | | 11/2015 | Wiryana et al. | |
| 2003/0142453 | A1 | | 7/2003 | Parker et al. | |
| 2004/0184211 | A1 | | 9/2004 | Bender et al. | |
| 2005/0012791 | A1 | | 1/2005 | Anderson et al. | |
| 2005/0204548 | A1 | | 9/2005 | Aisenbrey | |
| 2006/0267137 | A1 | | 11/2006 | Gambino et al. | |
| 2008/0130180 | A1 | | 6/2008 | de Palma et al. | |
| 2010/0165585 | A1 | | 7/2010 | Lin et al. | |
| 2010/0200898 | A1 | | 8/2010 | Lin et al. | |

FOREIGN PATENT DOCUMENTS

| | | | |
|---|---|---|---|
| JP | 2000-331590 | A | 11/2000 |
| JP | 2001-076611 | A | 3/2001 |
| JP | 2003-173728 | A | 6/2003 |
| JP | 2003-263949 | A | 9/2003 |

OTHER PUBLICATIONS

Written Opinion of the International Searching Authority for PCT International Application No. PCT/IL2011/000820; date of completion of opinion: Sep. 24, 2012; dated Oct. 1, 2012.
Arthur Keigler, Zhen Liu, Bill Wu, Jim Zhang and Mark Welsh, "Active Boundary Layer Thinning in Advanced Packaging Electroplating", pp. 2-4, *Semiconductor Packaging*, Jun. 2006.
Chinese Language Office Action dated Jun. 3, 2014 in Chinese Patent Application No. 201110462528.7.
English Language translation of Office Action dated Jun. 3, 2014 in Chinese Patent Application No. 201110462528.7.
Bibliographic data for CN1153577 obtained from espacenet.com (Aug. 21, 2014).
Bibliographic data for CN1649065 obtained from espacenet.com (Aug. 21, 2014).
Patent Abstract of Japan for JP 2000-331590.
Machine translation of JP 2000-331590.
Patent Abstract of Japan for JP 2001-076611.
Machine translation of JP 2001-076611.
Patent Abstract of Japan for JP 2003-173728.
Machine translation of JP 2003-173728.
Patent Abstract of Japan for JP 2003-263949.
Machine translation of JP 2003-263949.

* cited by examiner

LOW CURRENT FUSE

PRIORITY CLAIM

This application claims the benefit of previously filed U.S. Provisional Patent Application entitled "LOW CURRENT FUSE," assigned U.S. Ser. No. 61/393,149, filed Oct. 14, 2010, and which is incorporated herein by reference for all purposes.

FIELD OF THE INVENTION

The present subject matter relates generally to electrical fuses and particularly to land grid array (LGA) and surface mount (SMD) milli-current fuses employing thin film technology. The present technology further relates to methods for fabricating such fuses.

BACKGROUND OF THE INVENTION

Surface mounting has become a preferred technique for circuit board assembly. As a consequence, virtually all types of electronic components have been or are being redesigned for surface mount (i.e., leadless) embodiments or applications. The rapid incorporation of surface mount devices (SMD) into all types of electronic circuits has created a corresponding need for SMD fuses.

Fuses serve an essential function on many circuit boards. By fusing a circuit, selected sub-circuits and/or even certain individual components, it is possible to prevent damage to an entire system which may otherwise result from failure of a single, local component.

There are many different performance characteristics of electrical components for which improvement may be sought to facilitate desired operation. A prior example of technology that addresses certain fuse aspects is disclosed in U.S. Pat. No. 7,570,148 to Parker et al. The Parker et al. patent concerns a low resistance fuse including a fuse element layer and first and second intermediate insulation layers extending on opposite sides of the fuse element layer and coupled thereto. The fuse element layer is formed on the first intermediate insulation layer and the second insulation layer is laminated to the fuse element layer. Another example is U.S. Pat. No. 5,296,833 (Breen et al.). Breen et al. concerns a surface mount fuse device including an alumina-glass-fuse-glass-alumina laminated structure.

Additional references that disclose exemplary technology with aspects of fuse design include U.S. Pat. Nos. 5,228,188, and 5,166,656 both to Badihi et al. Such Badihi et al. references generally concern surface mount fuses and methods for making the same.

The disclosures of all the foregoing United States patent documents are hereby fully incorporated herein for all purposes by reference thereto. It will be noted that none of the prior art publications addresses the need to provide surface mountable fuses rated for milli currents of about 50 milli-amps. Preferred embodiments address this need in packages smaller than 80 mil×50 mil (about 2 mm×1.5 mm), and sometimes as small as 40 mil×20 mil (about 1 mm×0.5 mm).

SUMMARY OF THE INVENTION

The present subject matter recognizes and addresses various design aspects as previously discussed, and others concerning certain aspects of fuse and related electronics technology. Thus, broadly speaking, one principal object of the presently disclosed technology is to provide an improved fuse device. More particularly, the present disclosure describes a low current fuse device that may be configured in either a land grid array (LGA) configuration or a surface mount (SMD) configuration.

The present subject matter further relates generally to a multi layer fuse device, and more particularly to such a multilayer fuse device including a substrate with an elongated fuse element and a pair of integral contact pads formed therewith at opposed longitudinal ends thereof, formed on one surface of the substrate. In specific embodiments, a pair of passivation layers may be provided, covering the fuse and contact pads, and a pair of windows are opened through both passivation layers above both of the contact pads, so as to receive conductive electrode material electroplated therethrough. The electroplated material may extend above a top surface of the passivation layers and be coated with solderable conductive material.

There is a particular need for low current surface mounted fuses having ratings of 0.025 to 0.125 Amps.

Note: the rating of a fuse is the current for which it is intended. Fuses are generally designed to blow at a current of about 250% of the rated current.

A first aspect of the invention is directed to providing a surface mountable fuse rated to blow if exposed to a maximum current in the range of about 0.06 to 0.5 Amps.

Such a surface mounted fuse may be obtained using a thin film of appropriate metal.

Typically, the surface mountable fuse comprises a track of nickel or copper that is 3 to 20 micron wide and 0.2 to 2 microns thick.

Typically, the surface mountable fuse further comprises a dielectric substrate comprising ceramic, glass or glass ceramic.

Most preferably, the dielectric substrate comprises glass.

Typically, where the surface mounted fuse comprises a track of nickel, it further comprises a thin layer of tantalum below the fuse metal to promote adherence between substrate and metal.

Typically, the thin layer of tantalum has a thickness of several hundred angstroms.

Typically the surface mountable fuse further comprises a passivation layer protecting the fuse metal.

In one embodiment, the passivation layer comprises silicon oxynitride.

Optionally, a layer of tantalum is provided over the fuse metal and below the passivation layer to promote adhesion of the passivation layer to the fuse metal.

Optionally, the passivation layer is 1 to 6 microns thick.

Typically, the surface mountable fuse further comprises an encapsulation layer of polyimide.

Typically, the surface mountable fuse is configured for use in a land grid array (LGA) or in a surface mounted (SMD) application.

Most typically the surface mountable fuse further comprises terminations.

In one embodiment, the terminations comprise contact pads accessible through window openings in the passivation layer.

Typically, the surface mountable fuse further comprises an encapsulation layer of a polyimide material with window openings generally corresponding to those formed in the passivation layer.

Additionally the surface mountable fuse may comprise a protective coating of benzocyclobutene (BCB) or epoxy.

Optionally, the surface mountable fuse further comprises copper (Cu) electrodes electroplated through the window openings above the contact pads such that the electrodes extend over the passivation layer.

Typically, the exposed portion of the Cu electrodes 112 are terminated with nickel and tin (Ni/Sn) layers.

Alternatively, the exposed portion of the Cu electrodes are terminated using a ball grid array (BGA) technology.

In one exemplary embodiment, the presently disclosed subject matter relates to a fuse, comprising a substrate having respective top, bottom, side, and end surfaces; an elongated fuse element formed on such top surface of such substrate; a pair of contact pads integrally formed at opposed ends of such fuse element; at least one passivation layer covering such fuse element and at least a portion of such contact pads; first and second conductive electrodes coupled respectively to a top surface of each of such pair of contact pads; and at least one conductive termination layer for each of such electrodes.

In some embodiments, such first and second conductive electrodes may be coupled at one end thereof to one each of such pair of contact pads. In others, such first and second conductive electrodes each may have a second end thereof extending through such at least one passivation layer. In yet others, such at least one conductive termination layer may comprise a coating of such second end of each of such first and second conductive electrodes.

In other present alternatives, such first and second conductive electrodes along one edge thereof may extend to respective edge portions of such substrate. In others, such at least one conductive termination layer may comprise respective end terminations electrically associated respectively with each of such first and second conductive electrodes. In yet others, such first and second conductive electrodes may be coupled along one side thereof to one each of such pair of contact pads. In some of such others, such at least one conductive termination layer may comprise respective end terminations electrically associated respectively with each of such first and second conductive electrodes. In alternatives thereof, such termination layer may cover a portion of the sides of such substrate adjacent each end thereof.

In other presently disclosed variations, such a fuse exemplary embodiment may comprise at least a pair of such passivation layers covering such fuse element and contact pads. Further, such termination layer may cover at least a portion of such top surface of such passivation layers, and may cover part of such bottom and all of such end surfaces of such substrate proximate each end thereof, whereby such termination layer enables surface mounting of such fuse. Still further, such termination layer may cover a portion of the sides of such substrate adjacent each end thereof.

In other presently disclosed variations, such a fuse may further comprise a window formed above each of such contact pads through such pair of passivation layers; and wherein such first and second conductive electrodes may extend above a top surface of such passivation layers above such contact pads; and such termination layer may cover at least a portion of such conductive electrodes extending above the top surface of such passivation layers, and covers at least a portion of the bottom surface of such substrate, whereby such termination layer enables surface mounting of such fuse. Furthermore, in some instances such termination layer may cover a portion of the sides of such substrate adjacent each end thereof.

In yet other variations, such a fuse may further may comprise a glass layer covering such passivation layers; and wherein such first and second electrodes may extend in the direction of, and are exposed at, the ends of such substrate; and such termination layer may cover at least a portion of the top surface of such glass layer, and may cover the end and bottom surfaces of such substrate proximate each end thereof. In some alternatives, such passivation layers may comprise polymer materials. In others, such passivation layers may comprise one or more of SiNO, Al2O3, SiO2, Si3N4, a polymide, benzocyclobutene, and glass.

In other presently disclosed variations, such a fuse may further comprise a window formed above each of such contact pads through such at least one passivation layer; and wherein such first and second conductive electrodes may extend above a top surface of such at least one passivation layer above such contact pads; and such termination layer may cover at least a portion of such conductive electrodes extending above such top surface of such at least one passivation layer, whereby such termination layer enables grid array mounting of the fuse.

In other present alternatives such fuse element and such contact pads may be formed as integral multiple layers of adhesive and conductive materials. Further, such first and second conductive electrodes may be coupled at one end thereof to the nickel layer of one each of such pair of contact pads. Furthermore, such fuse element and such contact pads may be formed as an integral layer of at least one of copper, nickel, cobalt, and iron or alloys thereof. Also, in some alternatives, such first and second conductive electrodes may comprise conducting metal. Furthermore, such first and second conductive electrodes may comprise copper electrodes. In other arrangements, such substrate may comprise one of glass, glass ceramic, ceramic, silicon, and polymeric material. Further, the conductive termination layer may comprise a termination metal. Also, such termination metal may comprise layers of nickel and tin.

Additional objects and advantages of the present subject matter are set forth in, or will be apparent to those of ordinary skill in the art from, the detailed description herein. Also, it should be further appreciated by those of ordinary skill in the art that modifications and variations to the specifically illustrated, referenced, and discussed features and steps hereof may be practiced in various embodiments and uses of this subject matter without departing from the spirit and scope thereof, by virtue of present reference thereto. Such variations may include, but are not limited to, substitution of equivalent means and features, materials, or steps for those shown, referenced, or discussed, and the functional, operational, or positional reversal of various parts, features, steps, or the like.

Still further, it is to be understood that different embodiments, as well as different presently preferred embodiments, of the disclosed technology may include various combinations or configurations of presently disclosed features or elements, or their equivalents (including combinations of features or configurations thereof not expressly shown in the figures or stated in the detailed description).

Those of ordinary skill in the art will better appreciate the features and aspects of the presently disclosed subject matter upon review of the remainder of the specification.

BRIEF DESCRIPTION OF THE DRAWINGS

A full and enabling description of the presently disclosed subject matter, including the best mode thereof, directed to one of ordinary skill in the art, is set forth in the specification, which makes reference to the appended figures, in which.

Figure 1:
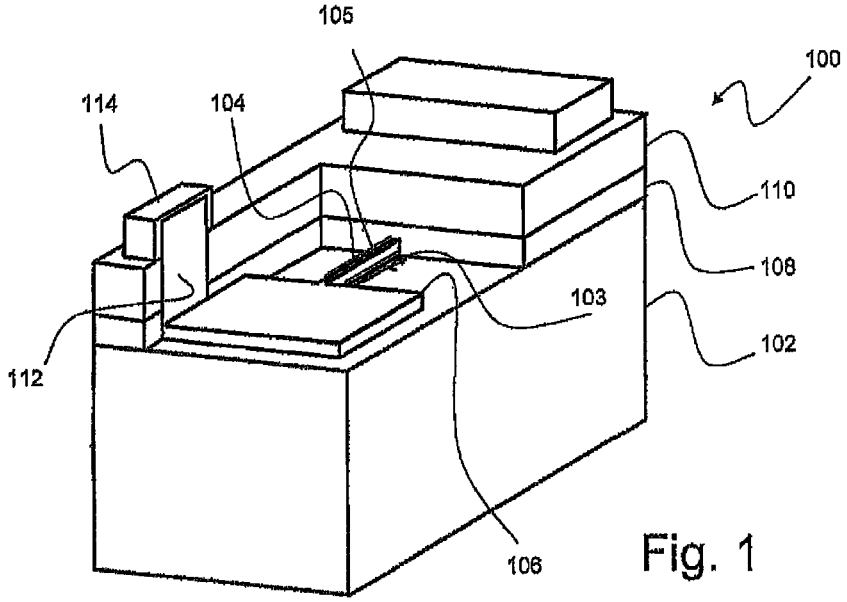
FIG. 1 illustrates a partial cutaway view of an exemplary first embodiment of a low current fuse in accordance with present technology.

Repeat use of reference characters throughout the present specification and appended drawings is intended to represent same or analogous features, steps, or other elements of the present technology.

DETAILED DESCRIPTION OF THE PREFERRED EMBODIMENTS

As referenced in the Summary of the Invention, aspects of the present subject matter are directed towards an improved low current fuse device.

Referring now to the drawings, FIG. 1 illustrates a cutaway view of an exemplary first embodiment of a low current fuse generally 100 in accordance with present technology. Low current fuse 100 is built up upon a number of layers, starting with a glass ceramic layer corresponding to substrate 102. A glass substrate is preferred but any ceramic such as alumina or other ceramic, silicon (Si), polymeric substrate with suitable thermal properties (with or without suitable passivation layers) or glass ceramic material may be employed.

Fuse element 104 with adhesive layer 105 and integral contact pads 106 (only one visible in FIG. 1) formed at each end thereof is produced by sputtering onto substrate 102, or other physical vapor deposition technique, and then by patterning layers of fuse metal. Various metals may be used for the fuse, including copper, which has high conductivity and ductility. It has been found that Nickel (Ni) is a good candidate, particularly for very low current fuses, it being noted that nickel shows a steep increase in electrical resistivity with temperature. Without wishing to be bound to any particular theory, it is believed that this is due to its ferromagnetic characteristics. Other magnetic materials, such as cobalt and some nickel and cobalt based alloys are expected to be advantageous. Thus in alternative embodiments, other magnetic metals (Ni, Co, Fe or their alloys) may be used.

Such metals demonstrate relatively low Joule heating and high resistance to electro-migration and other diffusion and thermally activated degradation processes. Nickel and Cobalt also have high ductility and resistance to corrosion in air, water and chlorides which provide reliable operation even in humid, mildly corrosive environments.

It will however be noted that other metals with appropriate resistance/melting points may also be employed for example.

The thickness of the fuse element 104 may vary, for example, from 0.2-2 μm. Such thicknesses may be relatively easily deposited to acceptable tolerances, Adhesion layers including, but not limited to, Ta, Cr, TaN, TiW, Ti, TiN, above and/or below the fuse material, may also be employed. Preferably a thin adhesive layer of tantalum (Ta) may be used to promote adhesion to the substrate.

Thicknesses for such adhesion layers 103 may vary, for example, from 100-1000 Å. It should also be appreciated by those of ordinary skill in the art that while fuse element 104 is illustrated as a straight line element, other configurations are possible where, for example, additional length is required or desirable. In certain of such instances, a generally curved or sinusoidal element may be provided.

A passivation layer 108 of silicon oxynitride (SiNO) with window openings over contact pads 106 is placed over element 104 and contact pads 106. In an exemplary configuration, passivation layer 108 may be about 1-6 microns thick and has window openings provided from either lithographic application of passivation layer 108 or via etching over a covering layer of the passivation material. In alternative embodiments, passivation layer 108 may be formed from any inorganic passivation material including, but not limited to, $Al_2O_3$, $SiO_2$, and $Si_3N_4$.

To aid adhesion of the passivation layer to the fuse metal thereunder, a thin layer of material, typically tantalum, but optionally Ta, Cr, TaN, TiW, Ti, TiN is added. The choice of the appropriate adhesion layer depends on the fuse metal, the passivation layer and deposition techniques, and, without wishing to be bound by specific technology, is designed to overcome phenomena such as lattice mismatch and residual stresses.

A second passivation layer or protective sealing layer 110, may be applied over the passivation layer 108. For fast deposition, the second passivation layer 110 may be a polymer such as a polyimide material of, for example, about 5-25 microns, and for example may also be formed with window openings (120 and 120' of FIG. 3) corresponding generally in scope to those (window openings 118 and 118') formed in passivation layer 108. In additional, optional embodiments, the second passivation layer 110 may also be supplied with a protective coating of benzocyclobutene (BCB),epoxy or other protective coating.

Electrodes 112 are then electroplated through the window openings over the contact pads 106 such that the electrodes 112 extend through the passivation layer 110. Where the fuse metal is copper, and even where it is another material such as nickel, for example, for ease of fabrication, the electrodes 112 are typically copper (Cu).

The exposed portion of the Cu electrodes 112 are then terminated, typically by coating with nickel and tin (Ni/Sn) layers 114. Other metals may be used, and may be particularly suitable for more specific termination requirements. In alternative configurations, ball grid array (BGA) technology may be employed with or without copper stud bumping techniques.

Figure 2:
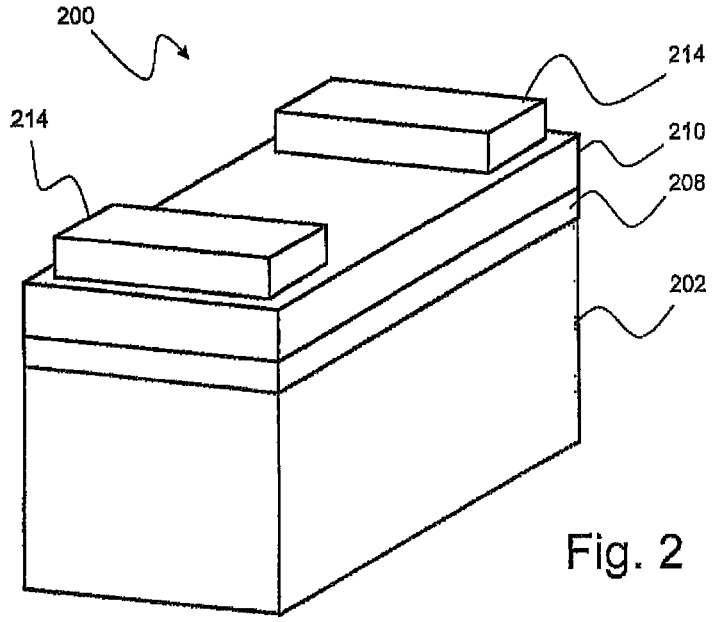
FIG. 2 illustrates an assembled, perspective view of the exemplary fuse embodiment of FIG. 1.

With reference to FIG. 2, there is illustrated an assembled, perspective view of an exemplary fuse 200 constructed in accordance with present technology. As may be seen from FIG. 2, fuse 200 includes substrate 202, passivation layers 208 and 210, and exposed Ni/Sn coatings 214 over the copper electrodes (not shown).

Figure 3:
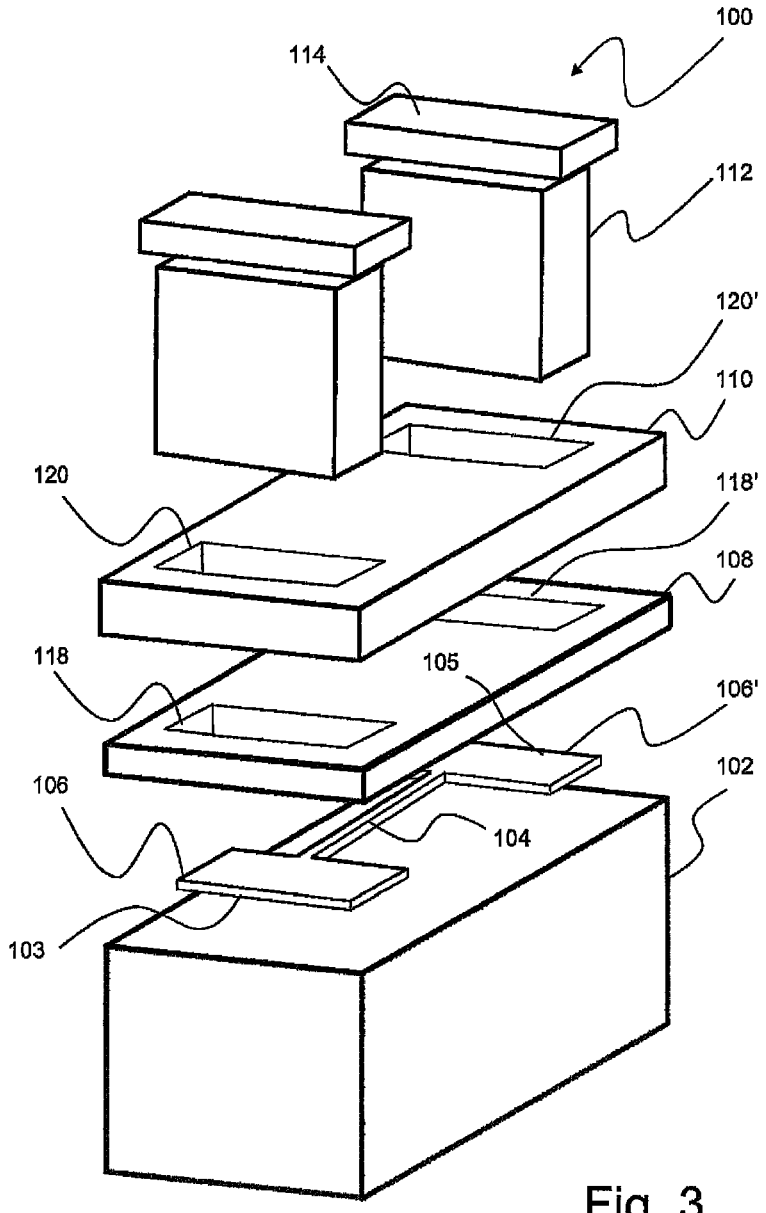
FIG. 3 illustrates an exploded view of the exemplary fuse embodiment of FIG. 1.

With reference to FIG. 3, there is illustrated an exploded view of an exemplary fuse 300 corresponding to the exemplary embodiment shown in FIGS. 1 and 2. Fuse 300, in exploded view, shows substrate 302 and more clearly illustrates the pair of contact pads 306, 306' associated with fuse element 304 and positioned at respective opposed longitudinal ends thereof. Further, openings 318, 318' and 320, 320' in passivation layers 308 and 310, respectively, are more fully illustrated. It will be appreciated that openings 318 and 320 are substantially coextensive in area, and uniformly aligned above contact pad 306. Openings 318' and 320' (on the opposite ends of passivation layers 308, 310) are similarly placed in relationship to contact pad 306'.

Figure 4A:
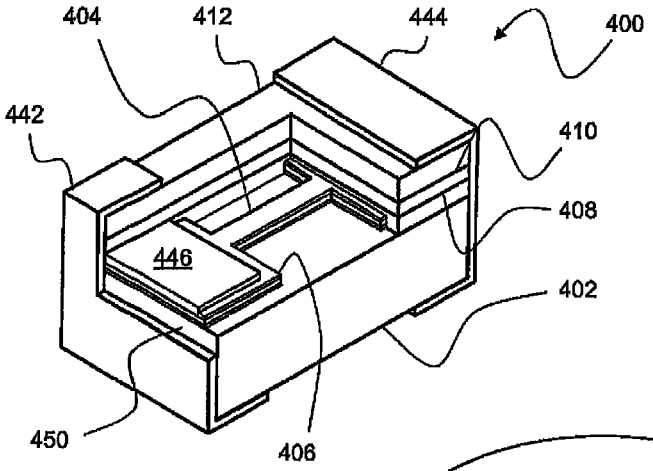
FIG. 4A illustrates a partial cutaway view of an exemplary second embodiment of a low current fuse in accordance with present technology configured for surface mount use.

Referring now to FIG. 4A there is illustrated a cutaway view of an exemplary second embodiment of a low current fuse generally 400 in accordance with present technology. Low current fuse 400 is built up upon a number of layers in substantially the same manner as previously illustrated with respect to FIG. 1, starting with a glass, ceramic, or glass ceramic substrate layer 402.

Figure 4B:
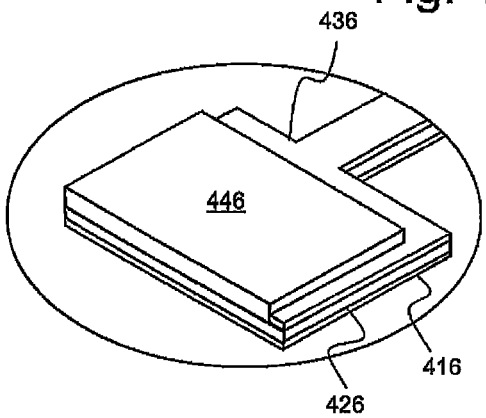
FIG. 4B illustrates an enlarged portion of the contact pad area of the FIG. 4A embodiment.

Fuse element 404 with integral contact pads 406 at each end thereof are formed by sputtering onto substrate 402, and then by patterning a fuse metal track, such as a layer of copper or nickel, with adhesion layers of Tantalum (Ta) thereunder and thereover. As will be understood by those of ordinary skill in the art, adhesion layers (not presently labeled but such as those represented by layers 103 and 105 in conjunction with FIGS. 1 and 3) may also be practiced per presently disclosed subject matter in conjunction with the embodiment of present FIG. 4A. As better seen in the enlarged contact pad area illustrated in FIG. 4B, in an exemplary configuration, a first Ta layer 416, followed by a Ni layer 426 and a second Ta layer 436 that together may combine to be from about 0.1 to about 10μ thick are sputtered over a glass substrate 402. As with fuse element 104 of FIG. 1, in alternative embodiments, magnetic metals such as Ni, Co, Fe or their alloys, or other metals such as copper having appropriate resistance/melting points may be employed. Similarly also with respect to FIG. 1, other adhesion layers above and/or below the fuse material, may also be employed.

In accordance with this second embodiment, a surface mount device (SMD) is provided by varying the electrode structure from that previously illustrated in connection with FIGS. 1-3. In accordance with the second embodiment, electrode material 446 may be provided above and in contact with the fuse metal (typically, nickel or copper) layer 426 and positioned to substantially cover Ni layer 406 and to extend to an edge portion 450 of substrate 402. In an exemplary configuration, the electrode material 446 may be copper (Cu) and may be electroplated over Ni layer 416. Other methods for providing Cu layer 446 may also be employed as would be recognized by those of ordinary skill in the art. It should also be appreciated that the electrodes may be fabricated from conductive materials other than Copper. In addition, it will be noted that this additional electrode material is not essential since the material forming the pad area and fuse are themselves conducting.

Following placement of electrode material 446, a first passivation layer 408 of silicon oxynitride (SiNO) followed by a second passivation layer or protective sealing layer 410 is applied over passivation layer 408. Finally a glass cover 412, or alternatively, other insulating material, may be applied In this embodiment, no window openings (as illustrated with respect to the first embodiment) are required, however windows may be formed to accommodate an electrode as will be described later with respect to the embodiments illustrated in FIG. 6. End terminations 442, 444 to permit surface mounting of the completed device may then be applied using techniques well known to those of ordinary skill in the art.

Figure 5:
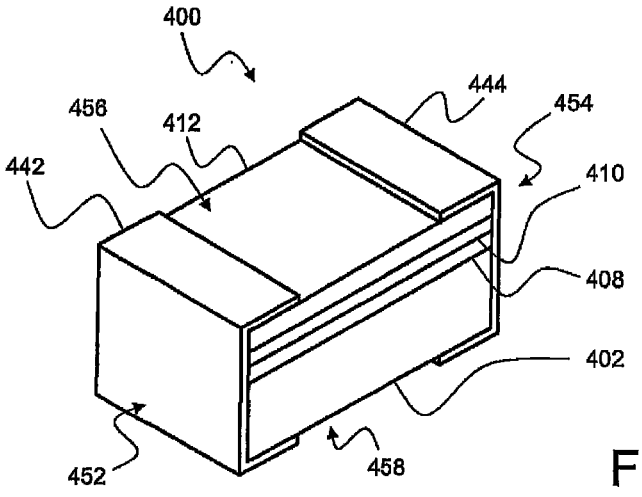
FIG. 5 illustrates an assembled, perspective view of the exemplary fuse embodiment of FIG. 4A.
Figure 8:
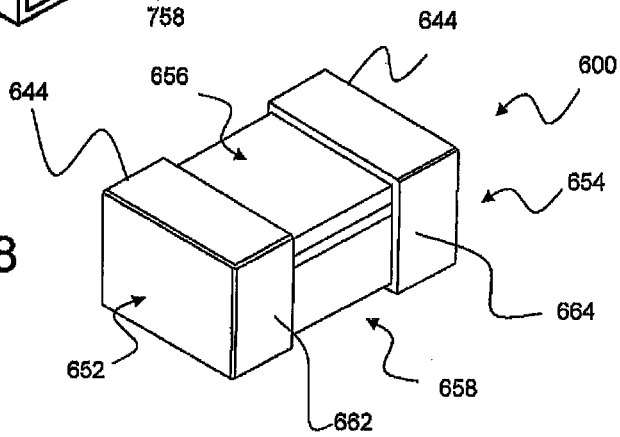
FIG. 8 illustrates an assembled, perspective view of the exemplary fuse embodiment of FIG. 6.

With reference to FIG. 5, there is illustrated an assembled, perspective view of an exemplary fuse 400 constructed in accordance with present technology. As may be seen from FIG. 5, fuse 400 includes substrate 402, passivation layers 408 and 410, and glass cover 412. End terminations 442, 444 are supplied at respective ends 452, 454 of device 400 and, as illustrated in FIG. 5 cover portions of both the top surface 454 and bottom surface 458. End termination material may optionally be applied to the side surfaces as illustrated in FIG. 8. End terminations 442, 444 may correspond to Cu terminations and may include coatings (not separately illustrated) of material such as Ni/Sn or other soldering material combinations to assist in securing the completed device to a circuit board, for example, using known soldering or other securing techniques.

Figure 6:
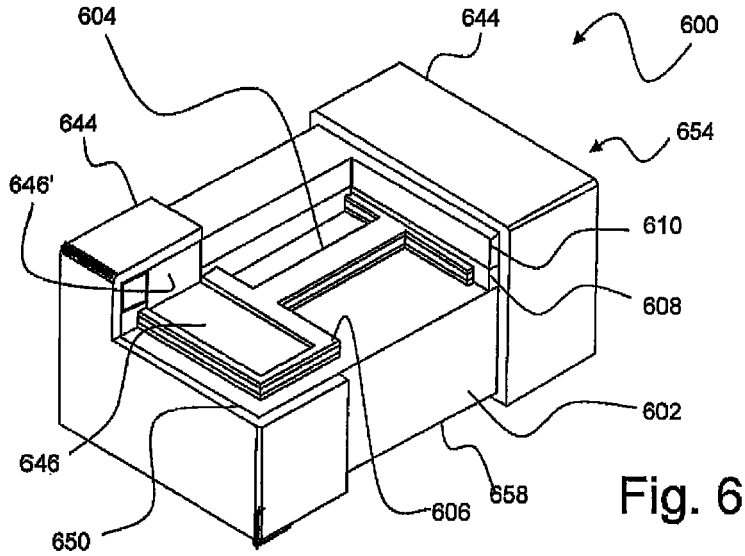
FIG. 6 illustrates a partial cutaway view of an exemplary third embodiment of a low current fuse in accordance with present technology configured for surface mount use.

Referring now to FIG. 6 there is illustrated a cutaway view of an exemplary third embodiment of a low current fuse generally 600 in accordance with present technology. Low current fuse 600 is built up upon a number of layers in substantially the same manner as previously illustrated with respect to FIGS. 1 and 3, starting with a dielectric layer such as a glass, ceramic or glass ceramic corresponding to substrate 602.

In accordance with this third embodiment of the present subject matter, a surface mount device (SMD) is provided by varying the electrode structure from that previously illustrated in connection with FIGS. 4-5. In accordance with the third embodiment, electrode material 646 may be provided above and in contact with metallic layer 606 and positioned to cover a portion of metallic layer 606. Electrode material 646 extends upwardly, as illustrated at cutaway portion 646,' possibly through windows in the passivation layers 608, 610 to extend at least to the surface of the upper passivation layer 610. End terminations 644, 644 to permit surface mounting of the completed device may then be applied using techniques well known to those of ordinary skill in the art as previously described with respect to FIGS. 4A and 5.

In the embodiment illustrated in FIGS. 6 and 8, termination material 644, 842, 644, 844, 852 may extend not only along the ends, top, and bottom surfaces of the completed device, but also along the sides as illustrated at 862, 864 in FIG. 8.

Figure 7:
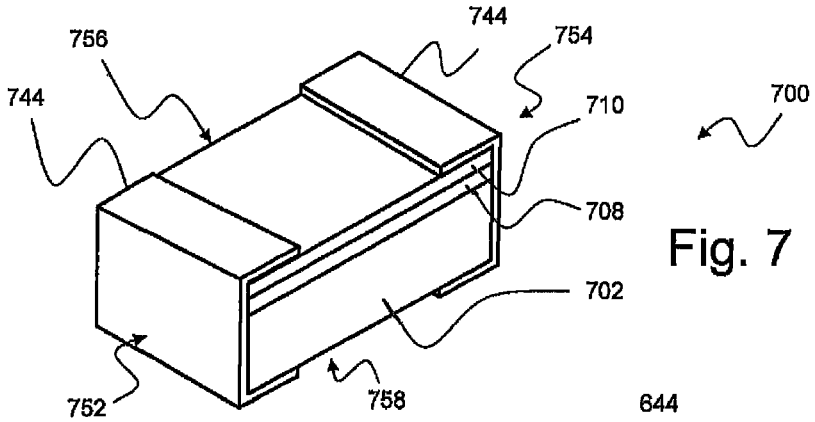
FIG. 7 illustrates an assembled, perspective view of the exemplary fuse embodiment of FIG. 6 showing an alternate termination.

With reference to FIG. 7, there is illustrated an assembled, perspective view of an exemplary fuse 700 constructed in accordance with present technology providing alternate termination where the termination material 744, 752, 744 is limited to the ends, and top and bottom surfaces of the completed device.

The theory and resulting equations for calculating appropriate dimensions (thickness, length and breadth for the strip of metal to serve as a fuse) are well understood.

Examples

With reference to FIG. 1, the following preferred embodiments are directed to providing low current fuses 100 rated to blow if exposed to currents exceeding a maximum current of between 0.1 and 0.5 amperes.

The dimensions are required to be accurately reproducible, and the fuses are required to have a high resistance to electromigration. Accurate, low current fuses of this type are obtainable by depositing a fuse element 104 consisting of a 3 to 20 μm (micron) wide track of nickel or copper having a predetermined thickness in the range of 0.2 to 2 micron, and preferably having integral pads 106

Preferably a thin layer 103 of tantalum is first deposited to obtain good adhesion and to prevent interaction between substrate 102 and nickel fuse element 104.

The substrate 102 selected was glass. It will be noted that a variety of glasses, ceramics or glass ceramics, may be used.

The thin layer 103 of tantalum may be deposited by physical vapor deposition (PVD) is typically several hundred angstrom thickness.

It has been found that for such fragile fuses, encapsulation by polyimide is appropriate.

A protective layer of silicon oxynitride may be first deposited by chemical vapor deposition over the nickel fuse element 104 to passivate, and then a second layer of 110 of polyimide may be applied over the passivation layer 108.

Preferably a second layer of tantalum is deposited over the fuse metal and below the passivation layer to obtain good adhesion of the passivation layer and to prevent interaction between fuse element 104 and the passivation layer.

The overall dimensions of such devices, once packaged may be less than 2 mm×3 mm and may be as small as 1 mm×0.5 mm, enabling them to be surface mounted in small devices.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A fuse, comprising:

a substrate having respective top, bottom, side, and end surfaces;

an elongated fuse element formed on said top surface of said substrate;

a pair of contact pads integrally formed at opposed ends of said fuse element;

at least one inorganic passivation layer contacting and covering said fuse element and covering at least a portion of said contact pads;

an adhesive layer comprising a metallic element;

wherein said adhesive layer is deposited between said fuse element and said passivation layer and at least a portion of the adhesive layer is in direct contact with at least one of the fuse element and the contact pads;

first and second conductive electrodes coupled respectively to a top surface of each of said pair of contact pads; and at least one conductive termination layer for each of said electrodes;

wherein said fuse element comprises a track of metal in the range of from 3 to 20 μm wide and from 0.2 to 2 μm thick, rated at 0.025 to 0.125 amps, residing between said substrate and said passivation layer, and protected from ambient environment while having improved support.

2. The fuse of claim 1, wherein said passivation layer comprises silicon oxynitride.

3. The fuse of claim 2, wherein said passivation layer is 1 to 6 microns thick.

4. The fuse of claim 2, further comprising a protective sealing layer of polyimide.

5. The fuse of claim 1, wherein said metallic element of the adhesive layer comprises tantalum and said adhesive layer having a thickness in a range from 100 to 1000 Å.

6. The fuse of claim 1, fabricated as a component having overall dimensions of not more than 3 mm×2 mm.

7. The fuse of claim 1, fabricated as a component having overall dimensions of not more than 1 mm×0.5 mm.

8. A fuse as in claim 1, wherein said fuse element comprises a track of nickel.

9. A fuse as in claim 1, wherein said substrate comprises a dielectric substrate formed of a material selected from the group comprising ceramic, glass and glass ceramic.

10. A fuse as in claim 1, configured for use in a land grid array (LGA) or in a surface mounted (SMD) application.

11. A fuse as in claim 1, further comprising window openings formed in said passivation layer for access to said contact pads for coupling of said electrodes respectively thereto.

12. The fuse of claim 11, further comprising a protective sealing layer of a polyimide material with additional window openings generally corresponding to the window openings formed in said passivation layer.

13. A fuse as in claim 1, wherein said electrodes comprise copper and said termination layer comprises nickel and tin layers.

* * * * *